US009931860B2

(12) United States Patent
Tokimatsu et al.

(10) Patent No.: US 9,931,860 B2
(45) Date of Patent: Apr. 3, 2018

(54) INKJET PRINTING APPARATUS

(71) Applicant: Konica Minolta, Inc., Chiyoda-ku, Tokyo (JP)

(72) Inventors: Hiroyuki Tokimatsu, Hino (JP); Mitsuru Obata, Sagamihara (JP); Shinya Takahashi, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/118,221

(22) PCT Filed: Jan. 21, 2015

(86) PCT No.: PCT/JP2015/051527
§ 371 (c)(1),
(2) Date: Aug. 11, 2016

(87) PCT Pub. No.: WO2015/125542
PCT Pub. Date: Aug. 27, 2015

(65) Prior Publication Data

US 2017/0182788 A1 Jun. 29, 2017

(30) Foreign Application Priority Data

Feb. 24, 2014 (JP) ..... 2014-032632

(51) Int. Cl.
*B41J 2/175* (2006.01)
*B41J 2/19* (2006.01)

(52) U.S. Cl.
CPC ..... *B41J 2/19* (2013.01); *B41J 2/17596* (2013.01)

(58) Field of Classification Search
CPC ..... B41J 2/19; B41J 2/17596; B41J 2/18
See application file for complete search history.

(56) References Cited

U.S. PATENT DOCUMENTS

2012/0081484 A1* 4/2012 Price ..... B41J 2/17523 347/92
2015/0056419 A1* 2/2015 Liu ..... B41J 3/407 428/195.1

FOREIGN PATENT DOCUMENTS

CN 203157378 U * 8/2013
CN 203157378 U 8/2013
(Continued)

OTHER PUBLICATIONS

CN Office Action corresponding to Application No. 2015800099151; dated Mar. 27, 2017.
(Continued)

*Primary Examiner* — Jason Uhlenhake
(74) *Attorney, Agent, or Firm* — Cantor Colburn LLP

(57) ABSTRACT

An inkjet printing apparatus includes an ink tank, a print head, an ink flow passage, a degassing device, a circulation flow passage and a circulation pump. The print head discharges ink supplied from the ink tank through the ink flow passage. The degassing device is disposed midway in the ink flow passage and removes air from the ink. The circulation flow passage has two ends respectively connected to two sides of the degassing device. The circulation pump is disposed midway in the circulation flow passage and returns the ink flowing out of the degassing device to a position to flow in the degassing device. The ink flow passage between an outflow port from the circulation flow passage and an inflow port thereto and the circulation flow passage are formed such that the ink is movable at approximately a constant speed.

9 Claims, 6 Drawing Sheets

(56) References Cited

FOREIGN PATENT DOCUMENTS

| | | | |
|---|---|---|---|
| JP | 2005059476 | A | 3/2005 |
| JP | 2006075683 | A | 3/2006 |
| JP | 2009279848 | A | 12/2009 |

OTHER PUBLICATIONS

International Preliminary Report on Patentability and Written Opinion of the International Searching Authority corresponding to Application No. PCT/JP2015/051527; dated Aug. 30, 2016, with English translation.
International Search Report corresponding to Application No. PCT/JP2015/051527; dated Apr. 21, 2015 , with English translation.

* cited by examiner

INKJET PRINTING APPARATUS

This is the U.S. national stage of application No. PCT/JP2015/051527, filed on Jan. 21, 2015. Priority under 35 U.S.C. § 119(a) and 35 U.S.C. § 365(b) is claimed from Japanese Application No. 2014-032632, filed Feb. 24, 2014, the disclosure of which is also incorporated herein by reference.

TECHNICAL FIELD

The present invention relates to an inkjet printing apparatus.

BACKGROUND ART

There is an inkjet printing apparatus which forms images on recording media by discharging ink from nozzles. The inkjet printing apparatus discharges a liquid ink from the ends of the nozzles by pressurizing the ink.

However, if air is in this liquid ink when the ink is pressurized, pressurization characteristics of the ink change and accordingly the ink may be not discharged at a desired speed with a desired amount, and/or fixation characteristics of the ink droplets dropped on recording media change, so that a problem of image quality deterioration arises. Then, there has been a well-known technique of removing air in ink with a degassing device provided.

In addition, as the upper limit of an ink consumption speed has been increasing due to increase in speed and definition of image forming with an inkjet printing apparatus, efforts have been made to increase efficiency of a degassing device and to make degree of degassing uniform, the degree of degassing being suitable for the ink consumption speed. There is described in Patent Document 1 a technique of: repeating, a desired number of times, a process of sending ink flowing out of a sub-tank to a degassing device to degas the ink and returning the ink to the sub-tank, wherein the sub-tank is disposed in an ink flow passage from an ink tank to nozzles, and the degassing device is connected to the sub-tank in parallel through a three-way valve; and thereafter switching the three-way valve to supply the ink from the sub-tank to the nozzles. There is described in Patent Document 2 a configuration to send ink in a sub-tank to a degassing device multiple times to repeatedly degas the ink, wherein the degassing device is disposed in a circulation flow passage attached to the sub-tank. There is described in Patent Document 3 a technique for increasing efficiency of degassing with a return flow passage to make ink flow, multiple times, in an ink flow passage where a degassing device and a sub-tank are arranged in series.

RELATED ART DOCUMENTS

Patent Documents

Patent Document 1: Japanese Patent Application Publication No. 2006-75683

Patent Document 2: Japanese Patent Application Publication No. 2009-279848

Patent Document 3: Japanese Patent Application Publication No. 2005-59476

SUMMARY OF THE INVENTION

Problems to be Solved by the Invention

However, if a sub-tank is disposed midway in a circulation passage which makes multiple times of degassing of ink possible, the conventional techniques have a problem that it takes a lot of time to increase the degree of degassing of ink in the sub-tank to a predetermined level and accordingly suspension of image forming with an inkjet printing apparatus is unavoidable.

In addition, because a degassing device ensures a vacuum state somewhere inside, heat conductivity to ink in the degassing device is low and accordingly it takes a lot of time to increase the ink temperature by heat. Circulation of ink in a degassing device is effective in efficiently heating the ink. However, if a sub-tank is disposed midway in a circulation passage, a problem arises that the effect thereof on the heating becomes small and accordingly it takes a lot of time to increase the ink temperature, in particular, at the time of start-up of an apparatus.

An object of the present invention is to provide an inkjet printing apparatus which can stably supply ink to nozzles while ensuring a desired degree of degassing with a simple configuration and operations.

Means for Solving the Problems

In order to achieve the above object, the present invention stated in claim 1 is an inkjet printing apparatus including: an ink tank where ink is stored; a print head which discharges the ink to form an image; an ink flow passage through which the ink is supplied from the ink tank to the print head; a degassing device which is disposed midway in the ink flow passage and removes air from the ink; a circulation flow passage having two ends respectively connected to two sides of the degassing device in the ink flow passage; and a circulation pump which is disposed midway in the circulation flow passage and returns the ink flowing out of the degassing device to a position from which the ink flows in the degassing device, wherein (i) the ink flow passage between an outflow port from the circulation flow passage and an inflow port to the circulation flow passage and (ii) the circulation flow passage are formed such that the ink is movable at approximately a constant speed.

The present invention stated in claim 2 is the inkjet printing apparatus according to claim 1, wherein the degassing device is provided with a heating part.

The present invention stated in claim 3 is the inkjet printing apparatus according to claim 2, wherein the ink is a gel ink which solates by being heated to a predetermined temperature or higher.

The present invention stated in claim 4 is the inkjet printing apparatus according to any one of claims 1 to 3, wherein a flow rate of the circulation pump is equal to or less than a maximum flow rate of the ink flow passage.

The present invention stated in claim 5 is the inkjet printing apparatus according to any one of claims 1 to 4, further including a control unit which controls operation of the circulation pump, wherein the control unit causes the circulation pump to operate to circulate the ink in the ink flow passage when an ink flow rate to the print head is equal to or less than a predetermined value.

The present invention stated in claim 6 is the inkjet printing apparatus according to claim 5, wherein the control unit causes the circulation pump to operate when the ink is not supplied to the print head.

The present invention stated in claim 7 is the inkjet printing apparatus according to any one of claims 1 to 4, further including a control unit which controls operation of the circulation pump, wherein the control unit causes or does not cause the circulation pump to operate depending on absence or presence of an ink discharge command related to image forming.

The present invention stated in claim 8 is the inkjet printing apparatus according to any one of claims 1 to 7, further including a first storage unit disposed between the inflow port to the circulation flow passage and the print head.

The present invention stated in claim 9 is the inkjet printing apparatus according to any one of claims 1 to 8, further including: a second storage unit disposed between the ink tank and the outflow port from the circulation flow passage; and a collection flow passage through which the ink in the print head returns to the second storage unit.

Advantageous Effects of the Invention

According to the present invention, an inkjet printing apparatus can stably supply ink to nozzles while ensuring a desired degree of degassing with a simple configuration and operations, and also can heat ink in a short period of time at the time of start-up of the apparatus.

EMBODIMENTS FOR CARRYING OUT THE INVENTION

Hereinafter, an embodiment of the present invention is described with reference to the drawings.

Figure 1:
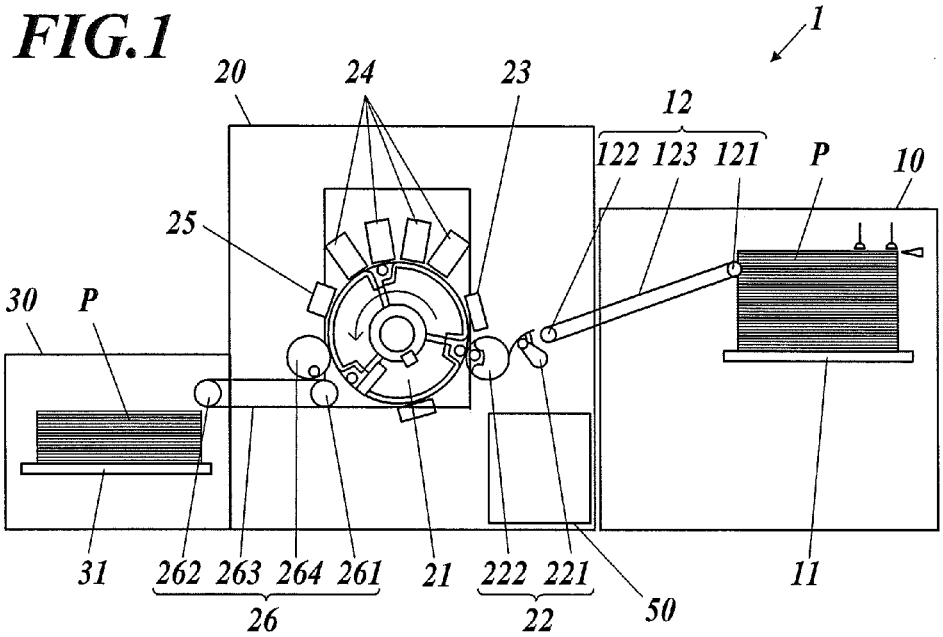
FIG. 1 is a schematic view showing the overall configuration of an inkjet printing apparatus according to an embodiment of the present invention.

FIG. 1 is a schematic view showing the overall configuration of an inkjet printing apparatus 1 according to an embodiment of the present invention.

The inkjet printing apparatus 1 includes a paper feed unit 10, an image forming unit 20, a paper receiving unit 30, a control unit 40 (shown in FIG. 7) and an ink supply unit 50. In the inkjet printing apparatus 1, based on the control of the control unit 40, after the image forming unit 20 forms, with ink supplied from the ink supply unit 50, images on recording media P carried from the paper feed unit 10 to the image forming unit 20, the recording media P are ejected to the paper receiving unit 30.

The paper feed unit 10 holds recording media P on which images are to be formed, and supplies the recording media P to the image forming unit 20 before image forming. The paper feed unit 10 includes a paper feed tray 11 and a conveyance unit 12.

The paper feed tray 11 is a plate-shaped member on which one or more recording media P can be placed. The paper feed unit 11 is configured to move up or down depending on the amount of recording media P placed thereon, and is held at such a position that the top recording medium P is carried by the conveyance unit 12.

The conveyance unit 12 includes: a conveyance mechanism composed of a looped belt 123 and a plurality (e.g., two) of rollers 121, 122 which rotationally drive the belt 123 and thereby carry recording media P on the belt 123; and a supply unit which transfers the top recording medium P of the recording media P placed on the paper feed tray 11 to the belt 123. The conveyance unit 12 carries, by rotation of the belt 123, the recording medium P transferred to the belt 123 by the supply unit.

The image forming unit 20 forms images on recording media P by discharging ink onto the recording media P. The image forming unit 20 includes an image forming drum 21, a transfer unit 22, a paper heating unit 23, head units 24, an emission unit 25 and a delivery unit 26.

The image forming drum 21 holds recording media P along its cylindrical outer circumferential surface, and carries the recording media P by rotating. The carrying surface of the image forming drum 21 faces the paper heating unit 23, the head units 24 and the emission unit 25 which perform, on the recording media P being carried, processes related to image forming.

The transfer unit 22 is disposed between the conveyance unit 12 of the paper feed unit 10 and the image forming drum 21, and transfers, to the image forming drum 21, the recording media P carried to the transfer unit 22 by the conveyance unit 12. The transfer unit 22 includes: a swing arm part 221 which holds one end of each recording medium P carried thereto by the conveyance unit 12; and a cylindrical transfer drum 222 which transfers the recording medium P held by the swing arm part 221 to the image forming drum 21. The transfer unit 22 picks up and transfers, with the swing arm part 221, the recording medium P on the conveyance unit 12 to the transfer drum 222, thereby guiding the recording medium P in such a way as to be along the outer circumferential surface of the image forming drum 21 and transferring the same to the image forming drum 21.

The paper heating unit 23 heats the recording medium P held by the image forming drum 21. The paper heating unit 23 has, for example, an infrared heater or the like, and generates heat by being electrified. The paper heating unit 23 is disposed near the outer circumferential surface of the image forming drum 21 on the upstream side of the head units 24 in a carrying direction of recording media P, which are carried by rotation of the image forming drum 21. Heat generation of the paper heating unit 23 is controlled by the control unit 40 such that the recording medium P which passes near the paper heating unit 23 while held by the image forming drum 21 becomes a predetermined temperature.

The head units 24 discharge ink to the recording medium P held by the image forming drum 21 to form an image(s) thereon. The head units 24 are provided for respective colors of C (cyan), M (magenta), Y (yellow) and K (black). In FIG. 1, the head units 24 for Y, M, C and K are disposed in this order from the upstream in the carrying direction of recording media P, which are carried by rotation of the image forming drum 21.

The head units 24 of the embodiment each have a length (width) which covers the entire recording medium P in a direction (width direction) perpendicular to the carrying direction of recording media P. That is, the inkjet printing apparatus 1 is a line-head inkjet printing apparatus employing a one-pass system. Each head unit 24 is composed of a plurality of print heads 24*a* arranged in such a way as to form a line head.

The emission unit 25 emits energy rays for curing ink which is used in the inkjet printing apparatus 1 of the embodiment, after the ink is discharged onto recording media P. The emission unit 25 has, for example, a fluorescent tube, such as a low-pressure mercury lamp, and emits the energy rays, such as ultraviolet rays, by causing the fluorescent tube to emit light. The emission unit 25 is disposed near the outer circumferential surface of the image forming drum 21 on the downstream side of the head units 24 in the carrying direction of recording media P, which are carried by rotation of the image forming drum 21. The emission unit 25 emits the energy rays onto the recording medium P, which is being held by the image forming drum 21 and onto which ink has been discharged, thereby curing the ink, which has been discharged onto the recording medium P, by action of the energy rays.

Examples of the fluorescent tube which emits ultraviolet rays include, in addition to the low-pressure mercury lamp, a mercury lamp having a working pressure of about several hundred Pa to 1 MPa, a light source usable as a germicidal lamp, a cold cathode tube, an ultraviolet laser light source, a metal halide lamp and a light emitting diode. Of these, a light source which can emit ultraviolet rays with higher illuminance and has low power consumption (e.g., a light emitting diode) is preferable. The energy rays are not limited to ultraviolet rays, and hence the energy rays which are suitable for the property of ink and accordingly have characteristics to cure the ink can be used. The light source is also replaced with another according to the waveform length or the like of the energy rays.

The delivery unit 26 carries the recording medium P irradiated with the energy rays by the emission unit 25 from the image forming drum 21 to the paper receiving unit 30. The delivery unit 26 includes: a conveyance mechanism composed of a looped belt 263 and a plurality (e.g., two) of rollers 261, 262 which rotationally drive the belt 263 and thereby carry recording media P on the belt 263; and a cylindrical transfer drum 264 which transfers recording media P from the image forming drum 21 to the conveyance mechanism. With the belt 263, the delivery unit 26 carries and sends out, to the paper receiving unit 30, the recording media P transferred to the belt 263 by the transfer drum 264.

The paper receiving unit 30 houses the recording media P sent out from the image forming unit 20 by the delivery unit 26. The paper receiving unit 30 includes a plate-shaped paper receiving tray 31 on which recording media P with images formed are placed.

The control unit 40 controls operation of each unit or the like of the inkjet printing apparatus 1, thereby controlling operation as a whole thereof. The control unit 40 includes a CPU (Central Processing Unit) 401, a ROM (Read Only Memory) 402 and a RAM (Random Access Memory) 403 (shown in FIG. 7). In the control unit 40, the CPU 401 reads programs from the ROM 402 and executes the read programs on the RAM 403, thereby performing various control processes.

The ink supply unit 50 stores ink and supplies the ink to the head units 24 of the image forming unit 20 so that inks of respective colors can be discharged from nozzles of the head units 24.

Figure 2:
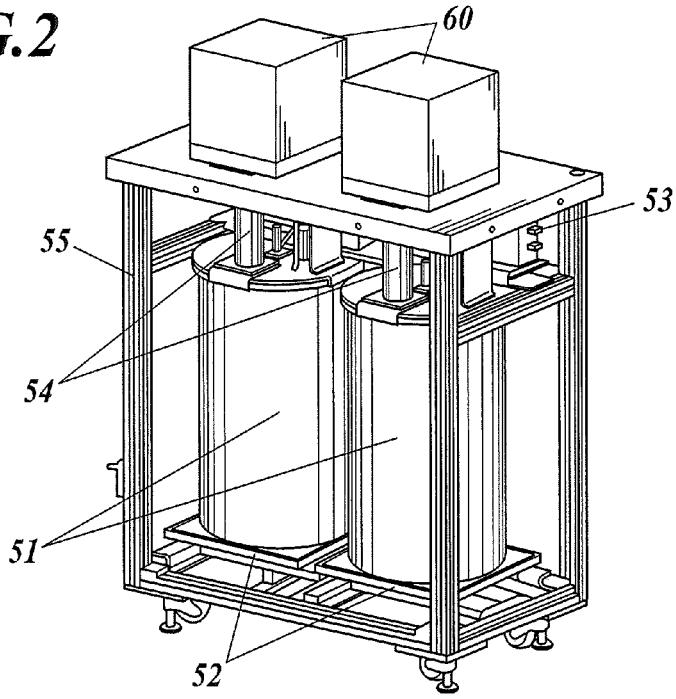
FIG. 2 is a perspective view of an ink supply unit.

FIG. 2 is a perspective view of the ink supply unit 50.

The ink supply unit 50 includes ink tanks 51, weight sensors 52, supply pumps 53, supply pipes 54 and a casing 55.

The ink tanks 51 are containers where inks of respective colors are stored. The inks pumped out of the ink tanks 51 by the supply pumps 53 are sent to the head units 24. Each ink tank 51 can store 20 L of ink, for example. To this ink tank 51, ink can be replenished from an attachable/detachable ink pack 60 via a supply pipe 54.

The ink(s) used in the inkjet printing apparatus 1 of the embodiment is not particularly limited; for example, an ultraviolet (UV) curable ink. This UV curable ink is a gel ink which changes its phase between the gel state and the liquid (sol) state according to the temperature unless the ink is irradiated with UV. For example, this ink has a phase change temperature of a predetermined temperature, for example, about 40° C. to 100° C., and evenly liquefies (solates) when heated to the phase change temperature or higher. Meanwhile, this ink gelatinizes (gelates) at the predetermined temperature or lower, which includes around normal room temperature (0° C. to 30° C.)

Figure 3:
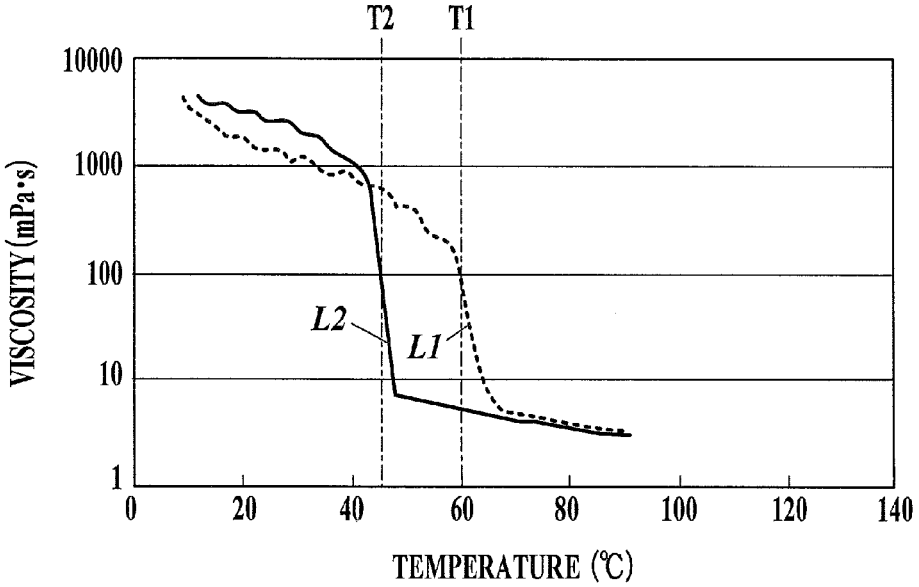
FIG. 3 shows an example of change in ink viscosity with increase and decrease in ink temperature.

FIG. 3 shows an example of change in ink viscosity with increase and decrease in ink temperature. A broken line L1 shows an example of change in ink viscosity during temperature increase, whereas a solid line L2 shows an example of change in ink viscosity during temperature decrease.

This ink changes its phase between the gel state where the viscosity is 100 mPa·s or more and the liquid (sol) state where the viscosity is less than 100 mPa·s (mainly less than 10 mPa·s). The change curve (broken line L1) of the ink viscosity during temperature increase and the change curve (solid line L2) of the ink viscosity during temperature decrease are different from each other. During temperature increase, when the ink temperature is 60° C. or higher, the ink viscosity is below 100 mPa·s, whereas during temperature decrease, when the ink temperature is lower than 45° C., the ink viscosity exceeds 100 mPa·s. That is, in this example of ink, when the ink temperature is 60° C. (T1: first temperature) or higher, no matter whether the temperature is increasing or decreasing, the viscosity is below 100 mPa·s, whereby the ink is liquid, whereas when the ink temperature is lower than 45° C. (T2: second temperature), no matter whether the temperature is increasing or decreasing, the viscosity exceeds 100 mPa·s, whereby the ink is gelatinous.

A method for producing this ink is disclosed, for example, in Japanese Patent Application Publication No. 2013-230633.

The weight sensors 52 are disposed under the respective ink tanks 51. Each weight sensor 52 measures the weight of the ink tank 51, performs digital conversion at a predetermined sampling rate, and then outputs the measured value data to the control unit 40.

The supply pumps 53 pump the inks out of the respective ink tanks 51, and send the inks to the image forming unit 20. The inks to be pumped up by the supply pumps 53 are each an ink composed of ingredients in the gel state mixed. Each supply pump 53 has sufficient lifting power to pump up the gel ink.

The supply pipes 54 are injection ports for the inks to be supplied to the respective ink tanks 51. Each supply pipe 54 is usually closed with a lid member or the like placed on the top, and when ink is to be supplied, the lid member is removed and an external ink pack 60 is stably attached to the top. Alternatively, the supply pipe 54 may be configured to be closed/opened with an ink pack 60 attached/detached to/from the supply pipe 54, without the separate lid member.

The casing 55 fixes and holds the components of the ink supply unit 50. This casing 55 has, on the bottom, wheels and supporting legs which are extendable or up-and-down movable. The length of the supporting legs is adjustable as needed. The casing 55 can be moved with the wheels or immovably disposed at a predetermined position with the supporting legs.

Figure 4:
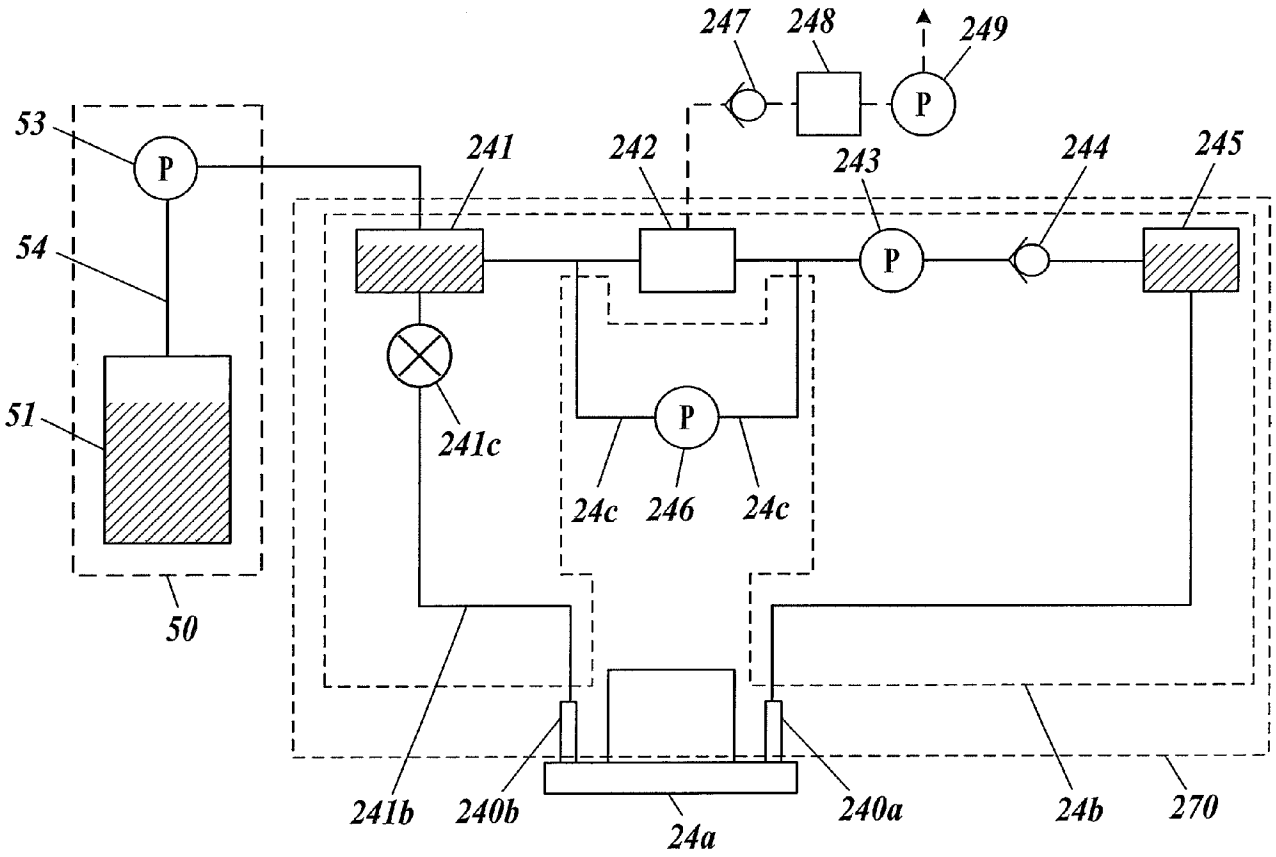
FIG. 4 is a drawing to explain an ink flow passage.

FIG. 4 is a drawing to explain an ink flow passage in the inkjet printing apparatus 1 of the embodiment.

In the inkjet printing apparatus 1 of the embodiment, the ink pumped out of the ink tank 51 of the ink supply unit 50 by the supply pump 53 thereof is supplied to the print heads 24*a* via an ink flow passage 24*b*. The undischarged ink from each print head 24*a* can be returned to the ink flow passage 24*b*.

In the ink flow passage 24*b*, there are disposed a second sub-tank 241 (second storage unit), a degassing module 242, a liquid feed pump 243, a check valve 244, a first sub-tank 245 (first storage unit) and so forth. They are connected with one another, not particularly limited to but, by a hollow annular tube structure.

Further, a circulation pump 246 is disposed to be parallel to the degassing module 242, and ink flowing out of the degassing module 242 can be returned to in front of the inflow port of the degassing module 242 via a circulation flow passage 24*c* connected to the both ends of the degassing module 242.

Hence, the ink flows at approximately a constant speed (i) from (a) the meeting point of the ink flow passage 24*b* and the outflow port of the circulation flow passage 24*c* to (b) the inflow port of the degassing module 242, (ii) from (a) the outflow port of the degassing module 242 to (b) the branching point of the ink flow passage 24*b* and the inflow port of the circulation flow passage 24*c*, and (iii) in the circulation flow passage 24*c*, according to the flow rates of the liquid feed pump 243 and the circulation pump 246. The "approximately a constant speed" means within a speed range which can be regarded as a constant speed in average with consideration given to the influence of fluctuation (pulsation) in the flow rates of the liquid feed pump 243 and the circulation pump 246.

These print heads 24*a*, the ink flow passage 24*b* and the circulation flow passage 24*c* are heated and kept warm by an ink heating unit 270 composed of a heater and a heat transfer member (s) which transfers heat of the heater, so that the ink temperature is kept at an appropriate temperature. As the heater of the ink heating unit 270, for example, a heating wire(s) is used, and generates Joule heat by being electrified. As the heat transfer members, members having a high thermal conductivity, for example, heat conductive plates formed of metal (alloy) of various types, are used and disposed to cover the pipes of the ink flow passage 24*b* and the circulation flow passage 24*c* and to contact the side walls of the second sub-tank 241 and the first sub-tank 245, for example.

Further, the degassing module 242 is connected with a check value 247, a trap 248 and a vacuum pump 249 in series, whereby a degassing device is configured.

Figure 5:
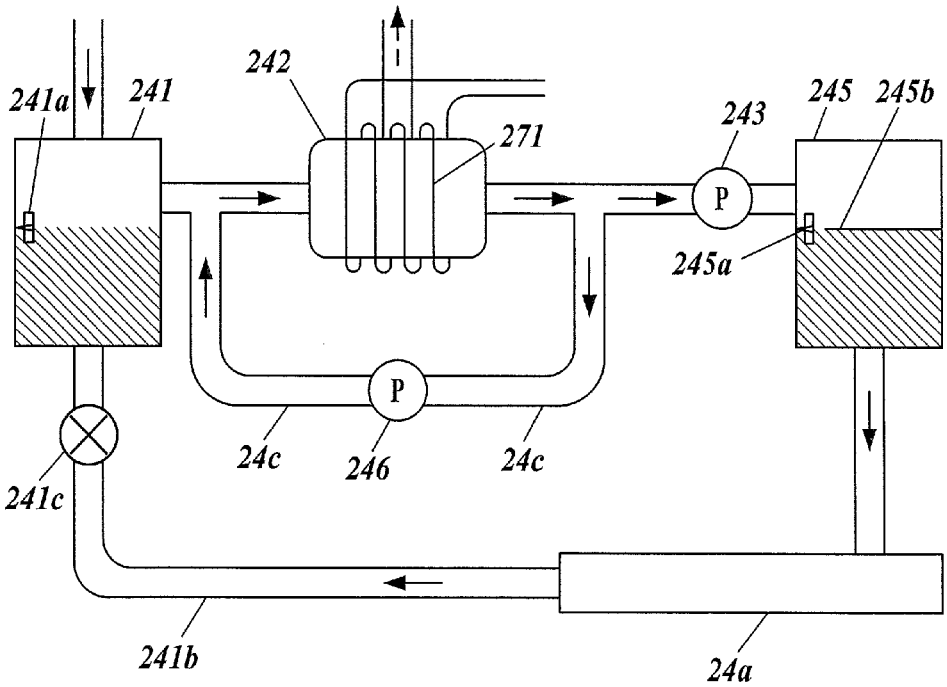
FIG. 5 is a cross-sectional view of a degassing chamber.

FIG. 5 shows the configuration of the ink flow passage in the inkjet printing apparatus 1 of the embodiment enlarged. In this figure, the check valve(s) provided as appropriate are not shown.

The second sub-tank 241 is composed of one or more ink chambers where the ink pumped out of the ink tank 51 by the supply pump 53 is stored. In general, the second sub-tank 241 has a capacity smaller than the ink tank 51 has. The second sub-tank 241 includes a float sensor 241*a*. Based on the data of the liquid level position detected by the float sensor 241*a*, the control unit 40 causes the supply pump 53 to operate, whereby a predetermined amount of ink is stored in the second sub-tank 241.

The degassing module 242 performs a degassing process to remove air from the ink flowing therein and exhausts the degassed ink. Although the degassing module 242 of the embodiment can usually reduce, by one time of degassing, concentration of the air in the ink to a level not exerting a bad influence on ink discharge, the degassing module 242 can further reduce the concentration of the air therein by multiple times of degassing.

Figure 6:
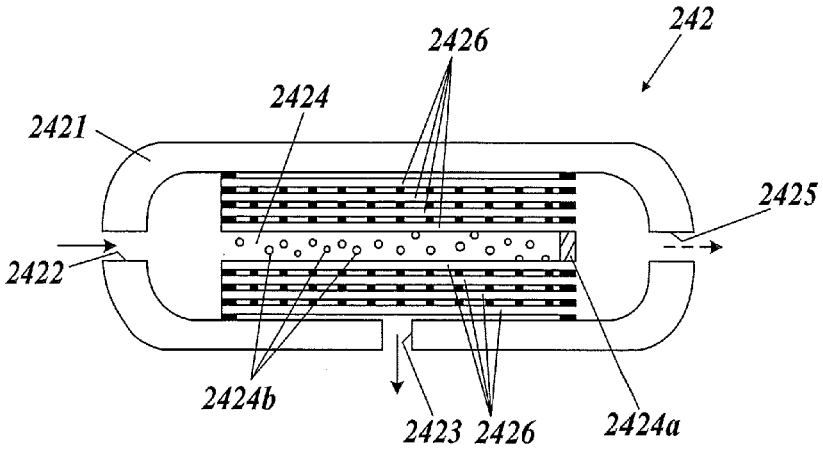
FIG. 6 shows the configuration of the ink flow passage enlarged.

FIG. 6 is a cross-sectional view of the cylindrical degassing module 242 cut at a plane passing through the central axis thereof.

The degassing module 242 is formed such that, in an outer shell 2421, a center pipe 2424 is covered around with a large number of hollow fiber membranes 2426. One end of the center pipe 2424 communicates with an ink inflow port 2422, and the other end thereof is sealed with a plug 2424*a*. Countless pinholes 2424*b* (perforations) are formed in the outer wall of the center pipe 2424. The ink flowing in the center pipe 2424 from the ink inflow port 2422 flows out thereof through these pinholes 2424*b* to the periphery and then flows out from an ink outflow port 2423 through gaps between the hollow fiber membranes 2426.

The hollow fiber membranes 2426 form a structure composed of a large number of hollow fine fibers with one end(s) thereof closed, and the membrane surface(s) thereof has gas permeability. The other end(s) of the fine fiber structure of the hollow fiber membranes 2426 communicates with a gas outflow port 2425, and the fine fiber structure of the hollow fiber membranes 2426 is decompressed by air suction with the vacuum pump 249. When ink contacts the membrane surface of the hollow fiber membranes 2426 in this state, only the air in the ink selectively permeates the membrane surface, whereby the ink is degassed.

The liquid feed pump 243 sends the ink flowing out from the ink outflow port 2423 of the degassing module 242 to the first sub-tank 245. Between the liquid feed pump 243 and the first sub-tank 245, the check valve 244 is disposed to prevent the ink once sent to the first sub-tank 245 from flowing backward.

The first sub-tank 245 is a small ink chamber where the ink degassed at the degassing module 242 is temporarily stored, and, although not particularly limited to, has a capacity about the same as the second sub-tank 241 has. The first sub-tank 245 is connected to an inlet 240*a* of each print head 24*a* and supplies ink to each print head 24*a* according to the ink amount to be discharged from the nozzles. The first sub-tank 245 includes a float sensor 245*a*. Based on the data of the liquid level position detected by the float sensor 245*a*, the control unit 40 causes the liquid feed pump 243 to operate, whereby a predetermined amount of ink is stored in the first sub-tank 245. The first sub-tank 245 also includes a float lid 245*b* to cover the surface of the degassed ink. Because the first sub-tank 245 is left open to the air, the float lid 245*b* makes the contact area of the air with the degassed ink small, thereby preventing the air from entering the degassed ink. In the inkjet printing apparatus 1 used for industrial usage, because of the continuous image forming or the like, the degassed ink is not stored in the first sub-tank 245 for a long period of time. Hence, the amount of the air entering the degassed ink is often small. Therefore, the first sub-tank 245 may be configured without this float lid 245*b*.

The undischarged ink from the nozzles of each print head 24*a* can be returned to the second sub-tank 241 from an outlet 240*b* via a collection passage 241*b* (collection flow passage) and a valve 241*c*. When ink needs to be let out of the print heads 24*a* for maintenance or the like, the valve 241*c* is opened, so that the ink in the print heads 24*a* can be collected without being wasted.

Between the degassing module 242 and the vacuum pump 249, the trap 248 is disposed via the check valve 247. Although the hollow fiber membranes 2426 are usually not permeable to a liquid ink, a fine amount of ink may permeate them depending on the degree of negative pressure by the vacuum pump 249. If this permeated ink reaches the vacuum pump 249, the vacuum pump 249 deteriorates. Hence, the trap 248 collects the ink before the ink reaches the vacuum pump 249. The ink collected by the trap 248 can be extracted therefrom by opening a not-shown valve connected to the trap 248.

As described above, in this inkjet printing apparatus 1, the degassing module 242 is disposed midway in the normal ink flow passage from the ink tank 51 to the print head (s) 24*a*, and ink passes through the degassing module 242 at least one time. That is, the degassing process on the ink supplied from the ink tank 51 and supply of the degassed ink to the print heads 24*a* are performed as parallel operations, without switching. In parallel to this degassing module 242, the circulation pump 246 and the circulation flow passage 24*c* are disposed, so that ink can be made to flow in the degassing module 242 multiple times as needed. Hence, for example, when image forming is in suspension, or the amount of ink to be used is small and accordingly there is enough ink, the degree of degassing can be increased by performing degassing multiple times. Further, at the time of power-on of the inkjet printing apparatus 1, the degree of degassing of ink which has decreased can be rapidly increased or recovered. Further, although decrease in the degree of degassing due to ink's stay in the first sub-tank 245 hardly becomes a problem as described above, when residence time of the ink in the first sub-tank 245 becomes relatively long due to the amount of ink to be discharged being small, the degree of degassing of the ink may be increased with the degassing module 242. Hence, an effect of keeping the degree of degassing of the whole ink in the first sub-tank 245 can also be obtained.

The flow rate of the circulation pump 246 can be appropriately adjusted by the CPU 401 of the control unit 40. For example, the flow rate of the circulation pump 246 may be controlled according to the amount of ink to be discharged by the print heads 24*a* such that the sum of the flow rate of the liquid feed pump 243 and the flow rate of the circulation pump 246 becomes uniform. Alternatively, simply, while the liquid feed pump 243 is in operation, the circulation pump 246 may be turned off, and while the liquid feed pump 243 is not in operation (or the ink flow rate is a predetermined value or less), the circulation pump 246 may be turned on. Alternatively, while the flow rate of the circulation pump 246 is fixed, the amount of ink to be supplied from the ink tank 51 may be changed according to the change in the flow rate of the liquid feed pump 243.

The maximum flow rate of the circulation pump 246 is equal to or less than the maximum flow rate of the ink flow passage 24*b*. Even if the flow rate of the circulation pump 246 is set to be more than the maximum flow rate of the ink flow passage 24*b*, the degassing module 242 cannot make enough ink flow in the circulation flow passage 24*c*. In particular, if the check valve 244 is not provided, ink flows backward from the first sub-tank 245. This causes a problem in ink discharge of the print heads 24*a*.

In the above, the flow rate of the circulation pump 246 is decreased against increase in the flow rate of the liquid feed pump 243. Alternatively, adjustment may be made such that a predetermined amount of ink circulates always. For that, the circulation pump 246 is caused to operate with a flow rate within a range up to the maximum flow rate of the ink flow passage 24*b* inclusive, wherein the flow rate of the circulation pump 246 to the flow rate of the liquid feed pump 243 is a predetermined ratio.

As described above, the ink in the ink flow passage 24*b* is heated and kept warm by the ink heating unit 270. In particular, the degassing module 242 is provided with a heating wire(s) 271 (heating part). Heat from the heater, the heat transfer plates and so forth which cover the outside is hardly conducted to the inside of the degassing module 242. Hence, by separately heating the degassing module 242 as described above to conduct heat to the inside thereof, ink can be more efficiently heated in the degassing module 242 where the residence time of ink is longer than the normal ink flow passage 24*b*. Further, in the inkjet printing apparatus 1 of the embodiment, even while supply of ink to the print heads 24*a* is stopped, the whole ink staying in the degassing module 242 and flowing in the circulation flow passage 24*c* is appropriately heated and kept warm with balance by appropriately circulating the ink in the degassing module 242 with the circulation pump 246. Further, even if ink is cold, for example, at the time of power-on of the inkjet printing apparatus 1, the ink can be rapidly heated, and accordingly circulated and discharged at an appropriate temperature.

Next, the internal configuration of the inkjet printing apparatus 1 is described.

Figure 7:
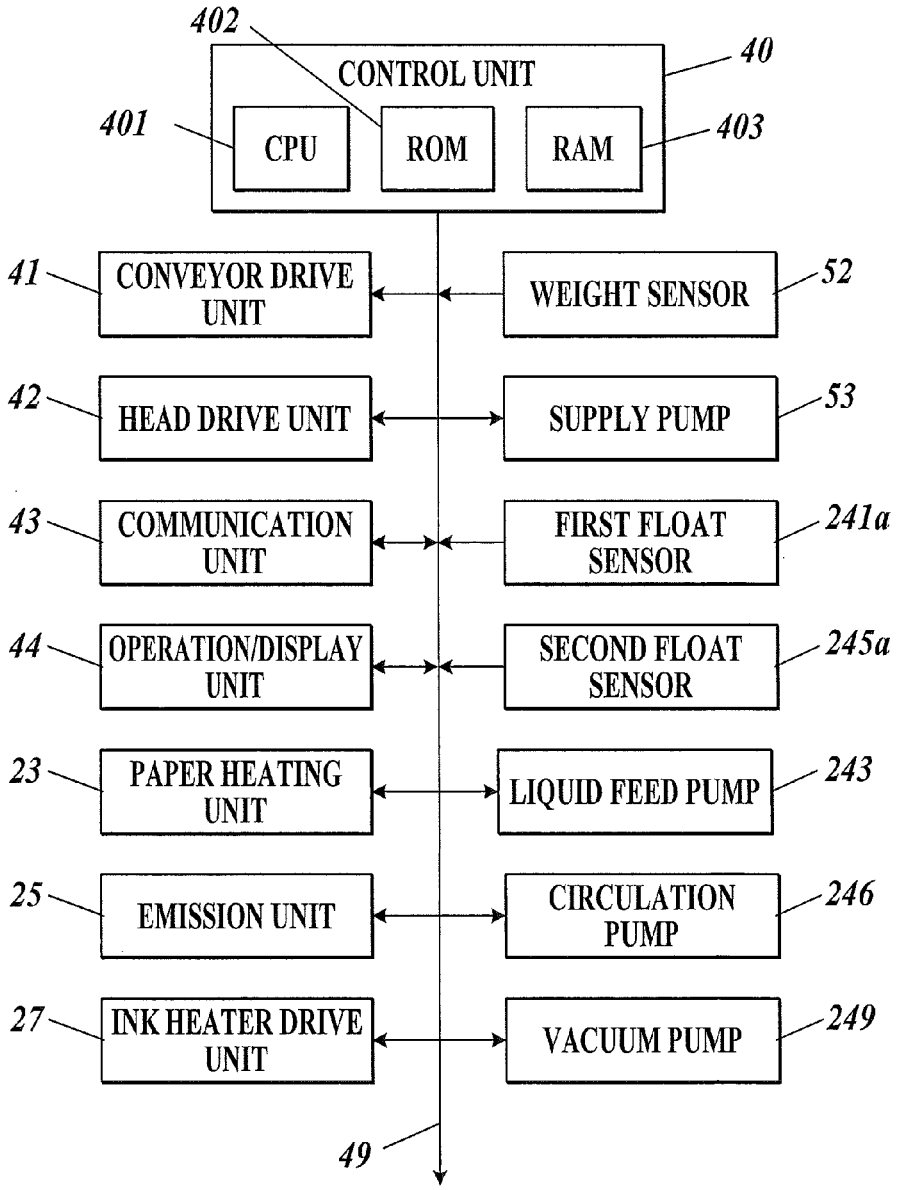
FIG. 7 is a block diagram showing the internal configuration of the inkjet printing apparatus.

FIG. 7 is a block diagram showing the internal configuration of the inkjet printing apparatus 1.

The inkjet printing apparatus 1 is configured such that the control unit 40, a conveyor drive unit 41, a head drive unit 42, a communication unit 43, an operation/display unit 44, the paper heating unit 23, the emission unit 25, an ink heater drive unit 27, the first float sensor (s) 241*a*, the second float sensor (s) 245*a*, the weight sensor(s) 52, the supply pump(s) 53, the circulation pump(s) 246, the liquid feed pump(s) 243 and the vacuum pump(s) 249 are connected to one another via a bus 49 so as to send/receive signals to/from one another.

A CPU 401 of the control unit 40 receives measurement signals or state signals from these units or the like and sends thereto control signals to cause them to appropriately operate.

Based on the control signals from the control unit 40, the conveyor drive unit 41 causes the paper feed unit 10, the image forming drum 21, the transfer unit 22 and the delivery unit 26 of the image forming unit 20, and the paper receiving unit 30 to operate to carry recording media P at appropriate timings and speed(s).

Based on the control signals from the control unit 40, the head drive unit 42 causes the head units 24 to discharge ink from the nozzles at appropriate timings, thereby forming images on recording media P.

The control unit 40 outputs the control signals to the conveyor drive unit 41, the head drive unit 42, the paper heating unit 23 and the emission unit 25 to cause them to operate at their respective appropriate timings to make recording media P face the nozzles of the head units 24 under the appropriate conditions and also to cure ink discharged onto the recording media P.

The communication unit 43 controls communications between the inkjet printing apparatus 1 and an external apparatus(es). Print jobs and various control signals from the external apparatus are received by the communication unit 43 and sent to the control unit 40. The control unit 40 performs various processes for image forming according to the obtained print jobs. Processes such as analysis and rasterization of image data may be performed by a CPU and/or a memory which are provided for image processing separately from the control unit 40.

The operation/display unit 44 is, for example, a touch panel having a liquid crystal screen and a touch sensor. The control unit 40 outputs display control signals thereto to cause the liquid crystal screen to display statuses, menus and so forth. The touch sensor accepts input operations from the outside and outputs input signals to the control unit 40. The control unit 40 performs various processes based on the input signals.

The ink heater drive unit 27 keeps the ink heating unit 270 at an appropriate temperature by switching the electrification state of the heater of the ink heating unit 270, so that the ink heating unit 270 heats the print heads 24*a*, the ink flow passage 24*b* and the circulation flow passage 24*c*, thereby changing the phase of ink to the liquid (sol) state and maintaining the ink at the liquid state. The ink heater drive unit 27 switches the electrification state under the control of the control unit 40 based on the temperature measured by, for example, temperature sensors disposed at parts of the ink heating unit 270.

[Modifications]

Figure 8:
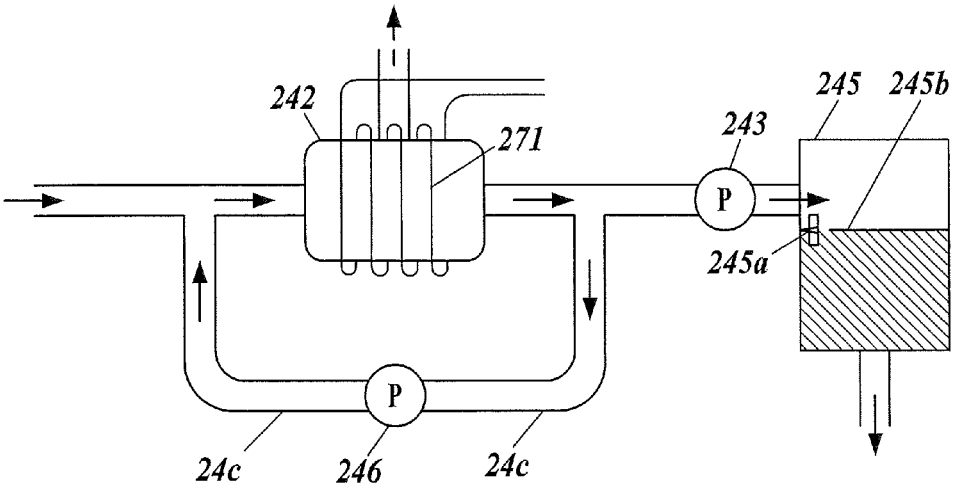
FIG. 8 shows a first modification of the configuration of the ink flow passage.

FIG. 8 shows a first modification of the ink flow passage 24*b* in the inkjet printing apparatus 1 of the embodiment.

In the ink flow passage 24*b* of the first modification, the second sub-tank 241 is not provided, and also the components related to the collection passage 241*b* from the outlet 240*b* of each print head 24*a* to the ink flow passage 24*b* are not provided either. The other components are the same as the above, and hence the same reference numbers as the above are attached thereto and descriptions thereof are omitted.

In the ink flow passage 24*b* of the first modification, ink is not returned from the print head(s) 24*a*. Hence, a necessary amount of ink should be directly supplied from the ink tank 51 as needed. The second sub-tank 241 is smaller than the ink tank 51. However, the more the amount of ink is, the higher the power consumption, which is required for heating the ink and keeping the ink warm, is. Elimination of the second sub-tank 241 can reduce the power consumption.

Figure 9:
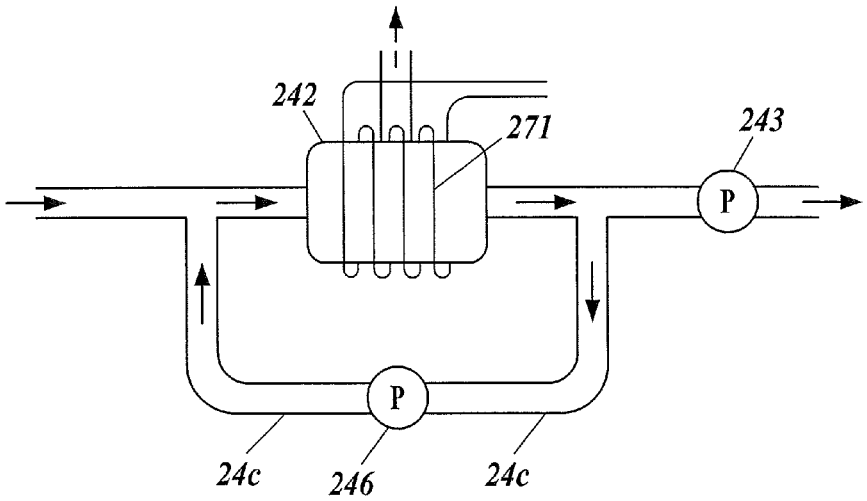
FIG. 9 shows a second modification of the configuration of the ink flow passage.

FIG. 9 shows a second modification of the ink flow passage 24*b* in the inkjet printing apparatus 1 of the embodiment.

In the ink flow passage 24*b* of the second modification, the first sub-tank 245 is not provided either. The other components are the same as the above, and hence the same reference numbers as the above are attached thereto and descriptions thereof are omitted.

By not providing the first sub-tank 245, the degassed ink is sent to the print heads 24*a* and discharged therefrom as it is. This further prevents the air from entering the degassed ink and allows the ink to be discharged at an appropriate temperature. However, in this case, ink pressure in the print heads 24*a* tends to be not uniform. Hence, it is desirable that presence or absence of the first sub-tank 245 in the inkjet printing apparatus 1 is determined depending on the operation characteristics such as high- or low-definition required for image forming. For example, in the case where high-definition image forming is not required, for example, in the case of sign painting, absence of the first sub-tank 245 hardly causes a problem.

As described above, the inkjet printing apparatus 1 of the embodiment includes: the ink tank 51; the print head(s) 24*a* which discharges ink to form an image; the ink flow passage 24*b* through which ink is supplied from the ink tank 51 to the print head 24*a*; the degassing module 242 which is disposed midway in the ink flow passage 24*b* and removes air from the ink; the circulation flow passage 24*c* having two ends respectively connected to two sides of the degassing module 242 in the ink flow passage 24*b*; and the circulation flow passage 24*c* which is disposed midway in the circulation flow passage 24*c* and returns the ink flowing out of the degassing module 242 to a position from which the ink flows in the degassing module 242, wherein no sub-tank is provided either (i) between an outflow port from the circulation flow passage 24*c* and an inflow port to the circulation flow passage 24*c* in the ink flow passage 24*b* or (ii) in the circulation flow passage 24*c*, so that the ink can flow therebetween and therein at approximately a constant speed according to the flow rates of the circulation pump 246 and the liquid feed pump 243.

Hence, non-degassed ink does not flow in the first sub-tank 245. This can prevent a situation where ink cannot be discharged until a degassing process ends from arising. This can also prevent a situation where even though the number of times of degassing increases, the degree of degassing hardly increases until the ink in a sub-tank in a circulation passage is replaced with another from arising. In particular, at the time of power-on of the inkjet printing apparatus 1, the degree of degassing can be rapidly increased and the ink temperature can be increased to an appropriate temperature, so that image forming can be promptly started.

The ink in a sub-tank does not flow out thereof evenly or in the order of flowing therein. Hence, the configuration not to return (circulate) the ink in the first sub-tank 245 to the degassing module 242 can prevent inks having different degrees of degassing from being unnaturally and unevenly distributed in the first sub-tank 245 and accordingly prevent uneven ink discharge and non-uniform image quality from occurring.

Further, the ink supplied from the ink tank 51 passes through the degassing module 242 without exception, and the degassed ink is sent to the print head 24*a* as it is. Hence, degassing of ink and supply of degassed ink to the print head 24*a* can be performed at the same time. Therefore, it is unnecessary to suspend image forming for degassing ink, and accordingly image forming can be performed continuously.

Further, control on the ink flow rate to be circulated is performed by the circulation pump 246, and accordingly the ink flow rate can be appropriately adjusted according to the liquid feed amount to the print head 24*a*. This can save the trouble of switching flow passages with a three-way valve or the like, and realize degassing and ink supply with a simple configuration and operations.

Further, the degassing module 242 of the degassing device is provided with the heating wire 271. Hence, the degassing module 242 can be heated separately from the entire ink flow passage, so that while degassing is performed in the degassing module 242, heat can be conducted to the part too which is difficult to directly deliver heat, and accordingly the ink temperature can be prevented from deceasing. Therefore, even if the ink flowing out of the degassing module 242 is soon discharged from the nozzles, the ink temperature can be stably kept at an appropriate temperature. In addition, ink can be prevented from gelatinizing in the degassing module 242 and not flowing.

Further, as ink, a gel ink which solates by being heated to a predetermined temperature or higher is used. Hence, processes related to fixing and drying can be performed more securely and effectively, and dots having a desired size and a desired density can be formed at a desired point on a recording medium.

Further, the flow rate of the circulation pump 246 is made to be equal to or less than the maximum flow rate of the ink flow passage 24*b*. Hence, while problems, for example, that the degassed ink flows backward and that the air enters the degassed ink, are prevented from arising, ink having a desired degree of degassing can be obtained with a necessary flow rate.

Further, the control unit 40 which controls operation of the circulation pump 246 is provided, and the control unit 40 causes the circulation pump 246 to operate to circulate the ink in the ink flow passage 24*b* when the ink flow rate to the print head 24*a* is equal to or less than a predetermined value. Hence, the degree of degassing can be appropriately adjusted in a situation where ink is not discharged much or at all.

In particular, the control unit 40 causes the circulation pump to operate when ink is not supplied to the print head 24*a*. Hence, even in the situation where ink is not discharged at all, namely, where ink is not sent from the liquid feed pump 243 to the first sub-tank 245, the ink as a whole can be kept in an appropriate temperature state with balance by appropriately moving the ink in the ink flow passage 24*b* and the circulation flow passage 24*c*.

Further, the control unit 40 causes or does not cause the circulation pump 246 to operate depending on presence or absence of an ink discharge command related to image forming. Hence, the degree of degassing of ink and the temperature thereof can be promptly adjusted before or in sync with timing of the actual start or suspension of operation related to ink discharge.

Further, the first sub-tank 245 is disposed between the inflow port to the circulation flow passage 24*c* from the ink flow passage 24*b* and the print head 24*a*. Hence, some amount of degassed ink can be stored in advance, and accordingly ink can be discharged at the time of image forming with some surplus kept. Further, only degassed ink is stored in the first sub-tank 245, and the ink does not circulate between the first sub-tank 245 and the degassing module 242. This configuration can prevent a situation where non-degassed ink enters the first sub-tank 245 and accordingly ink cannot be output immediately to the nozzles from arising.

Further, the second sub-tank 241 is disposed between the ink tank 51 and the outflow port from the circulation flow passage 24*c* to the ink flow passage 24*b*, and the collection passage 241*b* through which the ink in the print head 24*a* returns to the second sub-tank 241 is provided. Hence, the ink in the print head 24*a* can be reused without being wasted, in particular, at the time of maintenance. Further, by returning the ink to in front of the inflow side of the degassing module 242 at such time, the ink can pass through the degassing module 242 again while mixed with before-degassed ink, thereby being degassed again. Hence, evenly and sufficiently degassed ink can be resupplied.

The present invention is not limited to the above embodiment/modifications, and hence can be variously modified.

For example, in the above embodiment/modifications, the case where both the second sub-tank 241 and the first sub-tank 245 are provided, the case where neither of these is provided, and the case where only the first sub-tank 245 is provided are described as examples. Alternatively, only the second sub-tank 241 may be provided.

Further, in the above embodiment/modifications, the liquid feed pump 243 is provided to send ink to the first sub-tank 245. Alternatively, pumps and/or valves may be connected to the second sub-tank 241 and the first sub-tank 245 to generate pressure difference between the second sub-tank 241 and the first sub-tank 245 and thereby send ink to the first sub-tank 245.

Further, in the above embodiment/modifications, the heating wire 271 is wounded around the degassing module 242 to heat the degassing module 242 with particularly high efficiency in the ink heating unit 270. Alternatively, only heating the same as that performed on the other parts of the ink flow passage 24*b* may be performed. In this case, if the flow rate of the liquid feed pump 243 is not high, the flow rate of the circulation pump 246 may be increased to adjust the residence time of ink in the degassing module 242 to be short.

Further, in the above embodiment/modifications, a UV curable gel ink which solates by heat is used. However, ink to be used is not limited to a UV curable type. Even if the ink is a normal liquid ink, when the amount of the air contained in the ink increases, discharge performance of the print head 24*a* decreases. Hence, the present invention is also applicable thereto. In addition, the viscosity of many of this kind of liquid ink also changes, depending on the temperature. Hence, for these too, the ink heating unit 270 is preferably provided to heat ink in a short period of time at the time of start-up of an apparatus.

Further, in the above embodiment/modifications, the recording media P are described on the assumption that they are printing paper (printing sheets) which is supplied from the paper feed unit 10 and ejected to the paper receiving unit 30. However, the recording media P are not limited to paper media but include cloth and sheets of other than paper. Further, the inkjet printing apparatus 1 is not limited to a line head type employing a one-pass system, and hence may be one employing a two-pass system or a serial head type.

Further, in the above embodiment/modifications, descriptions of various types of valves and a pressurization mechanism(s), which are provided for maintenance, repair or the like in general, are not included. However, they can be appropriately provided. Further, the specific details of the units/components, arrangement thereof and so forth described in the above embodiment/modifications can be appropriately modified without departing from the spirit of the present invention.

INDUSTRIAL APPLICABILITY

The present invention is applicable to an inkjet printing apparatus provided with a degassing device.

DESCRIPTION OF REFERENCE NUMERALS

1 Inkjet Printing Apparatus
10 Paper Feed Unit
11 Paper Feed Tray
12 Conveyance Unit
121 Roller
122 Roller
123 Belt
20 Image Forming Unit
21 Image Forming Drum
22 Transfer Unit
221 Swing Arm Part
222 Drum
23 Paper Heating Unit
24 Head Unit
24*a* Print Head

24*b* Ink Flow Passage
24*c* Circulation Flow Passage
240*a* Inlet
240*b* Outlet
241 Second Sub-tank
241*a* Float Sensor
241*b* Collection Passage
241*c* Valve
242 Degassing Module
2421 Outer Shell
2422 Ink Inflow Port
2423 Ink Outflow Port
2424 Center Pipe
2424*a* Plug
2424*b* Pinhole
2425 Gas Outflow Port
2426 Hollow Fiber Membrane
243 Liquid Feed Pump
244 Check Valve
245 First Sub-tank
245*a* Float Sensor
245*b* Float Lid
246 Circulation Pump
247 Check Valve
248 Trap
249 Vacuum Pump
25 Emission Unit
26 Delivery Unit
261 Roller
262 Roller
263 Belt
264 Drum
27 Ink Heater Drive Unit
270 Ink Heating Unit
271 Heating Wire
30 Paper Receiving Unit
31 Paper Receiving Tray
40 Control Unit
401 CPU
402 ROM
403 RAM
41 Conveyor Drive Unit
42 Head Drive Unit
43 Communication Unit
44 Operation/Display Unit
49 Bus
50 Ink Supply Unit
51 Ink Tank
52 Weight Sensor
53 Supply Pump
54 Supply Pipe
55 Casing
60 Ink Pack
P Recording Medium

The invention claimed is:

1. An inkjet printing apparatus comprising:
an ink tank where ink is stored;
a print head which discharges the ink to form an image;
an ink flow passage through which the ink is supplied from the ink tank to the print head;
a degassing device which is disposed midway in the ink flow passage and removes air from the ink;
a circulation flow passage having two ends respectively connected to two sides of the degassing device in the ink flow passage; and
a circulation pump which is disposed midway in the circulation flow passage and returns the ink flowing out of the degassing device to a position from which the ink flows in the degassing device, wherein
(i) the ink flow passage between an outflow port from the circulation flow passage and an inflow port to the circulation flow passage and (ii) the circulation flow passage are formed such that the ink is movable at approximately a constant speed.

2. The inkjet printing apparatus according to claim 1, wherein the degassing device is provided with a heating part.

3. The inkjet printing apparatus according to claim 2, wherein the ink is a gel ink which solates by being heated to a predetermined temperature or higher.

4. The inkjet printing apparatus according to claim 1, wherein a flow rate of the circulation pump is equal to or less than a maximum flow rate of the ink flow passage.

5. The inkjet printing apparatus according to claim 1, further comprising a control unit which controls operation of the circulation pump, wherein
the control unit causes the circulation pump to operate to circulate the ink in the ink flow passage when an ink flow rate to the print head is equal to or less than a predetermined value.

6. The inkjet printing apparatus according to claim 5, wherein the control unit causes the circulation pump to operate when the ink is not supplied to the print head.

7. The inkjet printing apparatus according to claim 1, further comprising a control unit which controls operation of the circulation pump, wherein
the control unit causes or does not cause the circulation pump to operate depending on absence or presence of an ink discharge command related to image forming.

8. The inkjet printing apparatus according to claim 1, further comprising a first storage unit disposed between the inflow port to the circulation flow passage and the print head.

9. The inkjet printing apparatus according to claim 1, further comprising:
a second storage unit disposed between the ink tank and the outflow port from the circulation flow passage; and
a collection flow passage through which the ink in the print head returns to the second storage unit.

* * * * *